United States Patent [19]

Green

[11] 4,042,818

[45] Aug. 16, 1977

[54] LAMP ASSEMBLY

[75] Inventor: Stanley Green, Warley, England

[73] Assignee: The Lucas Electrical Company Limited, England

[21] Appl. No.: 667,336

[22] Filed: Mar. 16, 1976

[30] Foreign Application Priority Data

Apr. 1, 1975 United Kingdom ..... 13307/75

[51] Int. Cl.[2] ..... F21V 13/14

[52] U.S. Cl. ..... 240/41.3; 240/71 R; 240/41.4 R; 240/46.59

[58] Field of Search ..... 240/41.3, 41.4 R, 41.4 D, 240/39, 46.57, 46.59, 23, 41 C, 7.1 R, 9 R, 106.1, 41 R; 350/276 SL, 276 R, 314, 316

[56] References Cited

U.S. PATENT DOCUMENTS

| | | | |
|---|---|---|---|
| 1,955,173 | 4/1934 | Chambers | 350/276 |
| 2,170,552 | 8/1939 | DePorter | 240/46.57 X |
| 2,380,849 | 7/1945 | Kolb | 240/41.3 X |
| 3,679,291 | 7/1972 | Apfel et al. | 350/314 X |
| 3,744,893 | 7/1973 | Chandler | 350/276 SL X |
| 3,754,135 | 8/1973 | Hulbert, Jr. | 240/41.3 X |
| 3,766,373 | 10/1973 | Hedgewick | 240/41.3 X |
| 3,767,288 | 10/1973 | Gross | 350/276 R X |
| 3,798,445 | 3/1974 | Miles | 240/41.4 D X |

FOREIGN PATENT DOCUMENTS

| | | | |
|---|---|---|---|
| 1,226,006 | 9/1966 | Germany | 240/46.57 |

*Primary Examiner*—Edna M. O'Connor
*Attorney, Agent, or Firm*—Ladas, Parry, Von Gehr, Goldsmith & Deschamps

[57] ABSTRACT

A lamp assembly comprises a hollow body having two recesses therein, a bulbholder and a reflector in each recess, and a colorless transparent lens extending across the openings of the recesses. In one of the recesses is mounted a standard bulb and a filter element in the form of a domed cover surrounding the bulb. A neutrally colored light-absorbing material is incorporated into the filter element or is provided as a layer over a surface thereof remote from the bulb.

12 Claims, 1 Drawing Figure

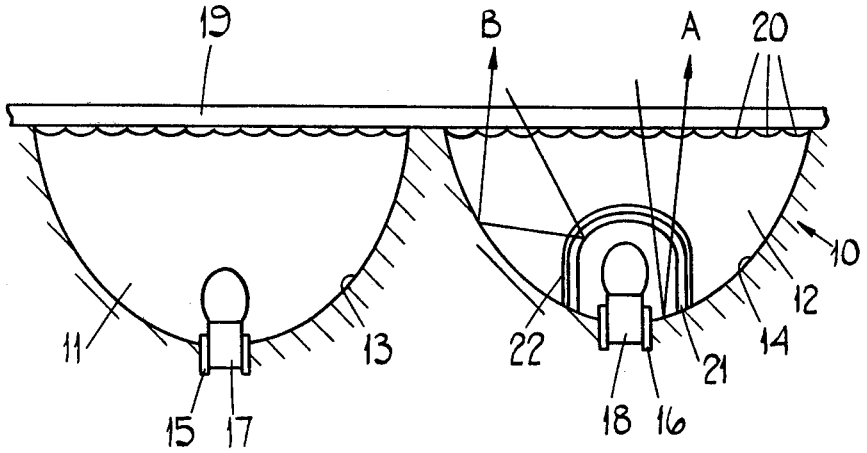
19
B
A
20
10
12
14
11
13
22
21
15
17
18
16

LAMP ASSEMBLY

This invention relates to a lamp assembly, particularly, but not exclusively, for use on a motor vehicle.

According to the present invention, there is provided a lamp assembly comprising a hollow body including a colourless lens, a reflector within the hollow body, a bulbholder for mounting a bulb in the body, a coloured filter element mounted in said body so as to cover said bulb in use, and a neutrally coloured light-absorbing material incorporated into said coloured filter element of provided as a layer on or over a surface of said filter element remote from said bulb.

The term "light-absorbing material" as used herein means a material which reduces the intensity of light passing therethrough, by absorbtion material. By "neutrally coloured light-absorbing material" is meant a material which substantially uniformly reduces the intensity of all wavelengths of the visible spectrum passing therethrough.

The light absorbing material may have a light transmission factor of between 20% and 75% inclusive and preferably it is 20% to 50% inclusive.

Preferably, the body includes two or more recesses therein, said reflector being provided in one of said recesses and a further reflector being provided in the or each other recess, and said colourless lens extends over said recesses.

An embodiment of the present invention will now be described, by way of example, with reference to the accompanying drawing, which is a schematic sectional view of a lamp assembly according to the present invention for use on a motor vehicle.

Referring to the drawing, the vehicle lamp assembly shown therein is in the form of a twin fog and direction indicator lamp unit. The lamp assembly comprises a body 10 having two recesses 11 and 12 therein. Each recess 11, 12 is provided with a respective dished reflector 13, 14 therein in the form of a vacuum-deposited aluminium film. Each reflector 13, 14 has a respective bulbholder 15, 16 at the rear thereof, in which is mounted a respective light bulb 17, 18. The recess 11, reflector 13, bulbholder 15 and bulb 17 together form the said foglamp, and the recess 12, reflector 14, bulbholder 16 and bulb 18 form the direction indicator lamp. A colourless transparent lens 19 extends across the openings of recess 11 and 12, and is provided with lensing 20 on a surface thereof adjacent the reflectors 13, 14.

An amber filter element, in the form of a domed cover 21, is mounted in the recess 12 so as to surround light bulb 18. A surface of the cover 21 remote from bulb 18 is provided with a layer 22 of light absorbing material thereon. The light absorbing material is neutrally coloured, and has a light transmission factor of between 25% and 50% inclusive, in this particular embodiment it is 50%. A suitable form of light absorbing material for this purpose is grey OROGLAS sheet manufactured by Rohm and Haas. This material is a so-called "neutral density material" and has the properties of a neutral filter.

In use, light emitted from bulb 18 passes through the cover 21, whereby it is given an amber colouring. The light then passes through the layer 22 of light absorbing material and suffers a 50% reduction in intensity. The resultant amber light of reduced intensity is re-directed by lensing 20 and passes through lens 19 to be viewable externally of body 10.

Light passing into recess 12 from the exterior of body 10 through lens 19 will partly be incident upon the cover 21. A part of this light then passes through the cover 21, is reflected by a portion of reflector 14 adjacent bulbholder 16, passes back through the cover 21 and then passes to the exterior of body 10 (as indicated by arrow A). A further part of the light is internally reflected at the interior surface of cover 21, passes back through cover 21 and then passes to the exterior of body 10, possibly after further reflection by reflector 14 (as indicated by arrow B). In each case, the light passes through the material of cover 21 and is coloured amber thereby. However, the light also passes through the layer 22 of light absorbing material twice, suffering a 50% reduction in intensity at each passage — i.e. giving a net reduction of 75%. It is thus difficult to appreciate the amber colouring of the cover 21 from the exterior of body 10 when the bulb 18 is not illuminated.

For lamp assemblies wherein a coloured light beam is to be produced, it has previously been the practice either to use a light bulb which itself emanates light of the required colour, or to use a standard bulb which emanates white light to incorporate the colouring into the lens 19. The use of a coloured filter element in the form of cover 21 enables a standard bulb to be employed and also enables the lens 19 to be formed of colourless material. In the particular embodiment described, the lens 19 can therefore be used for both the fog lamp and the direction indicator lamp, no special amber colouring being needed for the direction indicator lamp lens. Moreover, the provision of layer 22 of light absorbing material in the external surface of cover 21 prevents the colouring of the latter from being reflected by reflector 14, which would otherwise give the relector 14 an overall amber coloured appearance when viewed from the front of the direction indicator lamp. The reflector 14 thus appears to have substantially the same colouring as the reflector 13 of the fog lamp when the bulbs are not illuminated, and this gives a pleasing aesthetic appearance to the lamp assembly as a whole when the assembly is not in use.

As an alternative to using sheet neutral density light-absorbing material, the layer 22 can be formed by moulding it from acrylic neutral density light-absorbing powder.

Alternatively, the layer 22 can be formed by moulding it from polycarbonate based moulding powder having suitable light-absorbing properties and being of neutral density.

In place of the layer 22 of light absorbing material, light absorbing material may be incorporated into the material of the domed cover 21, or may be provided as a separate filter element disposed over the cover 21 with clearance.

I claim:

1. A lamp assembly comprising a hollow body, a reflector in said hollow body, a colorless lens overlying said reflector, a bulbholder disposed in said hollow body, a bulb mounted in said bulbholder, a colored filter element mounted in said hollow body and completely covering said bulb, and a neutrally colored light-absorbing material completely covering a surface of said colored filter element remote from said bulb, said light-absorbing material reducing the intensity of externally incident light passing therethrough said colored filter element and thereby causing the color of said colored filter element visible externally of said light-absorbing material to be subdued.

2. The lamp assembly according to claim 1, wherein said light-absorbing material comprises a layer on said surface of said colored filter element remote from said bulb.

3. The lamp assembly according to claim 2, wherein said layer is made of sheet light-absorbing material which has been formed to shape.

4. The lamp assembly according to claim 2, wherein said layer is made of light-absorbing powder which has been molded to shape.

5. The lamp assembly according to claim 4, wherein said light-absorbing powder is an acrylic powder.

6. The lamp assembly according to claim 4, wherein said light-absorbing powder is a polycarbonate-based powder.

7. The lamp according to claim 1, wherein said colored filter element is in the form of a domed cover disposed over said bulb.

8. The lamp assembly according to claim 7, wherein said light-absorbing material comprises a layer on a surface of said domed cover remote from said bulb.

9. The lamp assembly according to claim 1, wherein said light-absorbing material has a light transmission factor of between 20% and 75% inclusive.

10. The lamp assembly according to claim 9, wherein said light-asborbing material has a light transmission factor of between 20% and 50% inclusive.

11. A lamp assembly comprising a hollow body, a reflector in said hollow body, a colorless lens overlying said reflector, a bulbholder disposed in said hollow body, a bulb mounted in said bulbholder, a colored filter element mounted in said hollow body and completely covering said bulb, and a neutrally colored light-absorbing material incorporated throughout said colored filter element, said light-absorbing material reducing the intensity of externally incident light passing through said colored filter element and thereby causing the color of said colored filter element visible externally thereof to be subdued.

12. A lamp comprising a hollow body having at least two recesses therein, a reflector disposed in each recess, a bulbholder disposed in each recess, a bulb mounted in each bulbholder, a colorless lens extending over all of the recesses, a colored filter element mounted in one of the recesses and completely covering said bulb therein, and a neutrally colored light-absorbing material completely covering a surface of said colored filter element, said light-absorbing material reducing the intensity of externally incident light passing therethrough and through said colored filter element and thereby causing the color of said colored filter element visible externally of said light-absorbing material to be subdued.

* * * * *